US005922413A

United States Patent [19]

Takeda

[11] Patent Number: 5,922,413

[45] Date of Patent: Jul. 13, 1999

[54] METHOD FOR MANUFACTURING A COATED BODY OF METAL MEMBER FOR ELECTRONIC COMPONENTS

[75] Inventor: Susumu Takeda, 18-1, Daito 3-chome, Urawa-shi, Saitama, Japan

[73] Assignee: Susumu Takeda, Saitama, Japan

[21] Appl. No.: 08/933,384

[22] Filed: Sep. 19, 1997

[30] Foreign Application Priority Data

Sep. 19, 1996 [JP] Japan ..... 8-267730

[51] Int. Cl.[6] ..... B05D 1/06; B05D 5/12

[52] U.S. Cl. ..... 427/470; 427/475; 427/486; 427/104

[58] Field of Search ..... 427/470, 475, 427/485, 486, 409, 410, 104, 116

[56] References Cited

U.S. PATENT DOCUMENTS 3,832,226 8/1974 Kondo et al. .
4,139,672 2/1979 Ozawa et al. ..... 428/323
5,179,910 1/1993 Habsburg-Lothringen ..... 118/634

FOREIGN PATENT DOCUMENTS 9-51660 2/1997 Japan .
951660 2/1997 Japan .

OTHER PUBLICATIONS

"Electrostatic Powder Coating" by J.F. Hughes, Research Studies Press Ltd, pp. 1–28, 1984.

*Primary Examiner*—Shrive Beck
*Assistant Examiner*—Fred J. Parker
*Attorney, Agent, or Firm*—Birch, Stewart, Kolasch & Birch, LLP

[57] ABSTRACT

A method for coating a core of a small sized motor having a jig or the like by applying a liquid primer forming a primer coat film followed by applying a powder coating using either a friction charging type electrostatic powder gun or an inner charging type electrostatic powder gun. This method prevents rust from forming on the shaft hole and its peripheral portions covered by the jig, and it prevents the deterioration of the insulation coat film on the winding wires upon contact with burrs.

7 Claims, 5 Drawing Sheets

METHOD FOR MANUFACTURING A COATED BODY OF METAL MEMBER FOR ELECTRONIC COMPONENTS

BACKGROUND OF THE INVENTION

1. Field of the Invention

The present invention relates to a method for manufacturing a coated body of, for example, a core for a small-sized motor.

2. Prior Art

A small-sized motor having a core are useful in domestic electrical appliances, automobile electrical instrumentations, AV (audio-visual)units, electrical communication and others.

The core, as shown in FIG. 1, has a plurality of multipolar radial thin plates 3 having a shaft hole 1 and poles (slots) 2 formed from, for instance, thin metal sheets of 0.35 mm laminated through compression, and as shown in FIG. 2, an insulation coat film 4 is applied on a laminated body of multi-polar radial thin plates 3. Wire coated with insulation (not shown) is wound on the laminated body of respective slots through the insulation coat film 4.

The thin metal sheet used in the manufacturing process mentioned above, is initially formed by a press, resulting in the formation of burrs at its cut edges. These multi-polar radial thin plates 5 having burrs 5*a* are laminated and integrated as shown in FIG. 3, and the insulation coat film 4 as shown in FIG. 2 is formed (not shown) . Then, when the wire is wound, the winding force destroys the insulation coat film 4 on the burrs and the insulation film on the wires also exfoliate resulting in the reduction of the breakdown voltage between the wound wire and the core. The sharp points of these burrs are typically removed by laser cutting or blast; however, the edge of the laminated body of the multipolar radial thin plates 5 may also destroy the insulation coat film 4 by the winding force when the wire is wound resulting in the breakdown voltage reduction.

When the film thickness is at most about 20 $\mu$m, such as formed in electro deposition, the film does not extend beyond the burrs. Alternatively, electrostatic fluidized bed powder coating provides a thick film coating of 200 to 300 $\mu$m which affords great reliability for edge insulation. However, a thick coat film is inappropriate for small cores of several millimeters in diameter since the space between the slots is reduced limiting the number of windings and inhibiting the ability to obtain a high torque. Also the excessive winding length increases the heat generation by the increased resistance for cores of 10 mm in diameter for example. Therefore electrostatic powder coating methods are preferable because it allows the formation of the insulation coat film 4 of about 40 to 100 $\mu$m. In particular, the friction charged type electrostatic powder coating method or the inner charged type electrostatic powder coating method allow coating of the bottom of cavities of an electric member ensuring the desired film thickness of about 40 to 100 $\mu$m. This improves the edge cover rate, that is, the value obtained by multiplying by 100 the ratio y/x of the coat thickness y of the edge portion to the coat thickness x of the flat portion of the insulation coat film 4 shown in FIG. 2 as disclosed in Tokuganhei JP App. No. 7-221157, filed Aug. 8, 1995.

However, in this electrostatic powder coating method, as shown in FIG. 4, a shaft 6*a* composed of magnet is introduced into one of the sides of the shaft hole 1*a* of a core made of a laminated body of multipolar radial thin plates 3. While a shaft 6*b* made of iron is introduced into the other side, the core is supported and rotated by a jig composed of shafts 6*a* and 6*b* inserted into the respective collars 6*a*-1 and 6*b*-1, which are contacted to the periphery of this shaft hole 1*a* and coated by a coating gun. Therefore, the portions covered by the jig 6 and not powder coated, namely the inner wall of the shaft hole 1*a* and the portion around the both end faces thereof covered by the collars 6*a*-1 and 6*b*-1 can not be coated. Moreover, after the powder coating, the powder coat applied to the outer circumferential surface 3*a*-1 of the core 3*a* may detach before its baking resulting in an uncoated exposed portion.

Thus, if some portions remain uncoated, not only does rust eat these portions, but also moisture may enter from these portions into the gap between the multipolar radial thin plates 3 of the laminated body and rust may eat these multipolar radial thin plates.

When rust eats precise electronic devices that are recently coming into use, their long term reliability deteriorates.

Particularly, as the small-sized motor for the driving section of computer itself, hard disk, optical magnetic disk or other peripheral devices for the OA (office automation) unit, the FA (factory automation) unit or the like comes into wide use, it becomes all the more important to prevent rust from eating the core to ensure the motor reliability.

The first object of the present invention is to provide a method for manufacturing a coated body of metal member for electronic components having a coating film of the thickness that would not be destroyed even when the metal member for electronic components has burrs.

The second object of the present invention is to provide a method for manufacturing a coated body of metal member for electronic components having a coat film on a portion covered by a jig, which by previously known methods was unable to be coated.

The third object of the present invention is to improve the reliability of a small-sized motor that can keep a high torque for a long period of time to be used for computer related electronic devices.

The fourth object of the present invention is to provide a method for manufacturing a coated body that would not reduce the edge cover ratio of metal member for electronic components consisting of a thin, for example 100 $\mu$m or less, insulation coat film for a small electrical member having cavities.

The fifth object of the present invention is to provide a method for manufacturing a coated body of a metal member for electronic components having an insulation coat film that does not shorten the number of windings of the motor core thereby reducing its electric resistance and limiting its heat generation.

SUMMARY OF THE INVENTION

To solve problems mentioned above, the present invention provides: (1) a method for manufacturing a coated body of metal member for electronic components by forming a coat film on a metal member for electronic components, comprising the step of forming a primer coat film by foaming a liquid primer coating; and the step of forming a powder coat film by electrostatic powder coating method.

The present invention also provides: (2) a method for manufacturing a coated body of metal member for electronic components of (1) described hereinbefore, wherein the step of forming a primer coat film is a step of electro-deposition coating and the step of forming a powder coat film is performed after said step of electro-deposition coating; (3) a method for manufacturing a coated body of metal member for electronic components of (1) or (2) described hereinbefore, wherein the electrostatic powder coating of the step of forming a powder coat film is a powder coating formed with coating a friction charging type electrostatic powder gun or an inner charging type electrostatic powder gun; (4) a method for manufacturing a coated body of metal member for electronic components of any of (1) to (3) described hereinbefore, wherein the metal member for electronic components is a rotor core for electric motor; (5) a method for manufacturing a coated body of metal member for electronic components of any of (1) to (3) described hereinbefore, wherein the metal member for electronic components is a core for transformer; (6) a method for manufacturing a coated body of a metal member for electronic components to manufacture a coated body having a powder coating film on a metal member for electronic components having a jig, comprising the step of forming a primer coat film with the liquid primer coatings at least at the portion covered by the jig; and the step of forming a powder coat film by an electrostatic powder coating method; (7) a method for manufacturing a coated body of a metal member for electronic components of (6) described hereinbefore, wherein the step of forming the primer coat film is a step of electro-deposition and the step of forming the powder coat film is performed after the step of electro-deposition; (8) a method for manufacturing a coated body of a metal member for electronic components of (6) or (7) described hereinbefore, wherein the electrostatic powder coating of the step of forming the powder coat film uses a friction charging type electrostatic powder gun or an inner charging type electrostatic powder gun; and (9) a method for manufacturing a coated body of a metal member for electronic components of (8) described hereinbefore, wherein the metal member for electronic components is a core for electric motor.

In the foregoing, the metal member for electronic components is preferably a metal member for electronic components having (cavities and) a shaft hole or more preferably a metal member for electronic components having (cavities and) a shaft hole and burrs or alternatively a small (concave) metal member for electronic components. A coat film can also mean an insulation coat film.

On the other hand, (1) described hereinbefore is preferably a method for manufacturing a coated body of metal member for electronic components to manufacture a coated body having a powder coating film on a metal member for electronic components having a jig, comprising the step of forming a primer coat film with liquid primer coatings at least at the portion covered by the jig; and the step of forming a powder coat film by electrostatic powder coating.

In the primer coat film according to the present invention, it is more preferable that the rust prevention is more effective and that the adhesion with the metal surface of a metal member for electronic components and the powder coat film mentioned below is enhanced. The liquid coat provides enhanced adhesion, because the liquid coat may infiltrate well into fine and complicated points, and the antirust coat film can be formed all over the surface of a metal member for electronic components.

The liquid primer may be of the organic solvent type, aqueous type, emulsion type or the like. As for the composition thereof, it may contain only a liquid resin, or a resin liquid wherein the resin ingredient is dissolved or dispersed and, moreover, pigment or other various additives may be added thereto. Such coat film may be a clear coat without pigment or a coat film of enamel containing pigments.

The liquid primer coat can be applied by any of immersion coating, brush coating, spray coating or electrostatic spray coating; but, electro-deposition is preferable in which it allows to cover with the coat film without causing pinhole or other coat film faults on the metal surface of the coated body, and also, it can be applied to the gap between metal sheets, such as the laminated body of said multipolar radial thin plates 3.

Thus, if the liquid primer coat film formed on the coated body is of the hardening type, sometimes it is effective to stop at the half-harden state before applying powder coats in order to improve its adhesion, because when powder coats are applied thereon, if it hardens too much, the adhesion of such powder coat film is deteriorated.

Moreover, it is preferable that this liquid primer does not generate by-product gas, because as optical hard disk drives or hard disk drives of the application field where small-sized motor comes into wide use, the generation of such by-product gas provokes damage of implements and materials, short-circuit, or other problems. Considering these points, resins capable of crosslinking are preferred such as an epoxy resin by acid or amine, crosslinking of resins having hydroxyl group by di-isocyanate compound. This prevents by-products from generating from the liquid primer coat film.

According to the present invention, the step of forming a powder coat film should be devised to reduce heat generation as much as possible, because, as mentioned above, the small-sized motor in an enclosed state and is hard to dissipate heat. Therefore, for the core shown in FIG. 2, in order to reduce heat generation by the current flowing through the winding performed on the slot laminated body of the multipolar radial thin plates 3, it is preferable to make the thickness of the insulation coat film 4 disposed in such slot 100 $\mu$m or less, more preferably of 40 to 100 $\mu$m. Ideally the coat thickness is enough to fill up burr 5*a* between the multipolar radial thin plates 5.

As for methods for forming a thin film powder coat, a corona charging type electrostatic powder coat coating method is also used. The method comprises the steps of disposing a pin at the point of a coating gun, grounding the object to be painted and applying high voltage between them to discharge corona, charging powder particles using this electric field, coating the object to be coated of the opposite polarity and heating for hardening. This method can realize a thin film coating of about 40 $\mu$m, because it uses powder particles of 30 $\mu$m to 35 $\mu$m in average diameter. When this corona charging type electrostatic powder coat coating method is used to apply powder coats to the liquid primer coat film mentioned above, a required powder coat film thickness can be obtained at the core edge portion as shown in FIG. 2 at a preferred edge covering rate.

According to the corona charging type electrostatic powder coating method, when the object to be coated includes cavities, it is hard to produce an electric field in the cavities and powder is not applied to some portions because of the Faraday cage phenomenon. Therefore it is preferable to apply a powder coat using a friction charging type electrostatic powder gun or an inner charging type electrostatic powder gun.

A friction charging type electrostatic powder coating method comprising, as shown in FIG. 5 for example, comprises the steps of: introducing powder coatings with air into a tube of a gun, bringing the gun tube and the powder coatings into contact with the inner wall of tube, charging the powder coatings by friction, forming an air flow of its charged particles, depositing the charged particles to an object to be coated set to the polarity opposite to these charge particles and making it discharge. Such a coating method does not cause the Faraday cage phenomenon and presents excellent infiltration into cavities, whereas coating with the corona discharge method mentioned above, the electric field from the corona pin is hard to enter cavities of the object and the powder coats are applied only to the protruded portions due to the Faraday cage phenomenon.

On the other hand, to coat by an inner charging type electrostatic powder coating method, as shown in FIG. 6 for example, comprising passing particles through an electric field formed between an electrode disposed in a tube of a gun and an electrode plate, thereby charging the particles (so-called inner charging), then depositing the charged particles on an object set to the polarity opposite to the charge on the particles effecting discharge. In the same manner as the friction charging type electrostatic powder coating method mentioned above, the inner charging type electrostatic powder coating method does not cause the Faraday cage phenomenon and presents an excellent infiltration into cavities.

The powder coating may be applied using a corona discharge pin combined with a friction charging type electrostatic powder gun in order to increase the friction charging amount by the friction charging type powder coating method or the electrostatic powder gun may be used in parallel. The present invention also includes methods which are less sensitive to the Faraday cage effect than the corona discharge method and capable of applying sufficient powder to cavities of an object to be coated.

In friction charging or contact charging, there exists a charging order between objects about the charging amount and the charging polarity, for example, in the order of polyurethane, epoxy, polyamide, polyester, polyvinyl chloride, polypropylene, polyethylene, polytetrafluoroethylene, wherein the polymers appearing first in the list tend to be positive and the latter tend to be negative; the principle is known that when a positive component and a negative component are rubbed together, the positive one is charged positively and the negative one is charged negatively. The larger the separation between two components, the greater the charged amount, and it is already well-known that this principle can be applied to powder coats having additives such as pigment, hardener, hardening accelerator, fluidity adjuster, foaming inhibitor or the like. On the other hand, a nozzle made of the materials charged negatively is prepared. Alternatively, materials are selected so that the former is charged negatively and the latter is charged positively and they are rubbed against each other and charged by injecting powder coats from the nozzle and then, such friction charged particles can be applied to the object to be coated charged with the opposite polarity.

The powder to be applied by the friction charging electrostatic powder coating method or inner charging electrostatic powder coating method is preferably 4 μm to 40 μm in average particle diameter and the coat film thickness is 100 μm or less, while the powder used in the electrostatic fluidized bed powder coating method is 50 μm to 70 μm in average particle diameter and inherently films exceeding 100 μm in thickness. To obtain a coated film thickness of 50 μm to 100 μm, powder coatings of 30 μm to 35 μm in average particular diameter applied with an ordinary corona charging type electrostatic powder coating method may well be adopted, however, using fine particle powder coatings of 4 μm to 40 μm in average particle diameter, a coat film thickness of 50 μm or less, more particularly, of 30 μm or less can be obtained.

The particle size distribution of powder coatings of about 30 μm in average particle diameter comprises usually a variety of particle diameters from about 10 μm to 70 μm. The fine powder coatings of 20 μm or less in average particle diameter, useful in the ordinary corona charging type powder coat coating method, may be obtained by crushing with a pin mill, such as MICRO-ACM air classifier mill (made by Hosokawa Micron Co., Ltd. However industrially, it can be obtained by using a supersonic jet crusher "Acroplex" (made by Alpine Co., Ltd.) or a fine crusher Clitptron (made by Kawasaki Heavy Machinery Co., Ltd.) and by cyclone classification for cutting the upper and lower limits. Otherwise, first, fine particle powder coats of 10 μm or less is produced, then it is stirred and mixed using a fluidization type mixer such as Mitsui Henschel Mixer (made by Mitsue Mining Co., Ltd.) and several fine particles are heated and fused to form granules of arbitrary particle diameter.

As heating means, infrared radiation heating, induction heating, hot air heating or the like may be employed.

From the foregoing, "powder coat film" may well be "powder coat film or powder coat insulation coat film of 10 μm to 100 μm in coat film thickness" and, here, "powder coatings" may also be "powder coatings of 4 μm to 50 μm in average particle diameter".

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
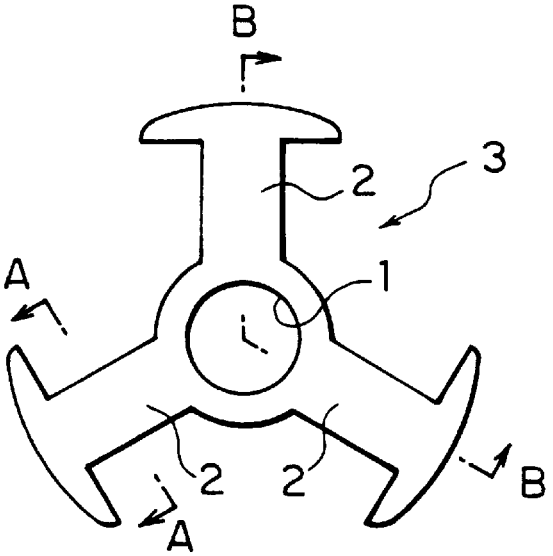
FIG. 1 is a plane view of a multipolar radial thin plate used for a core.
Figure 3:
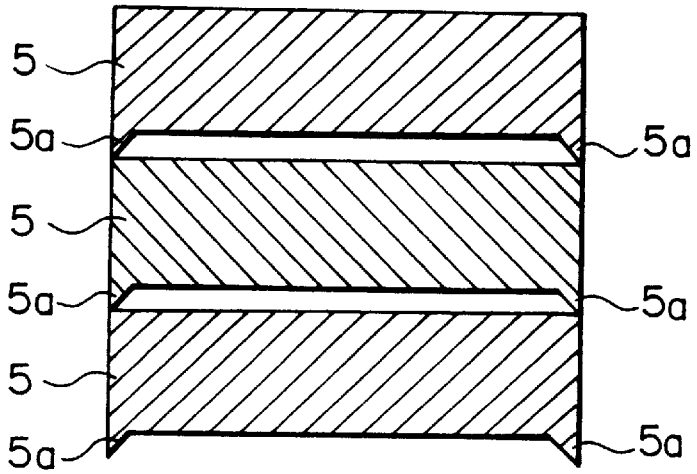
FIG. 3 is a cross-sectional view corresponding to the laminated body of FIG. 2 of a laminated body of a multipolar radial thin plate having burrs.
Figure 7:
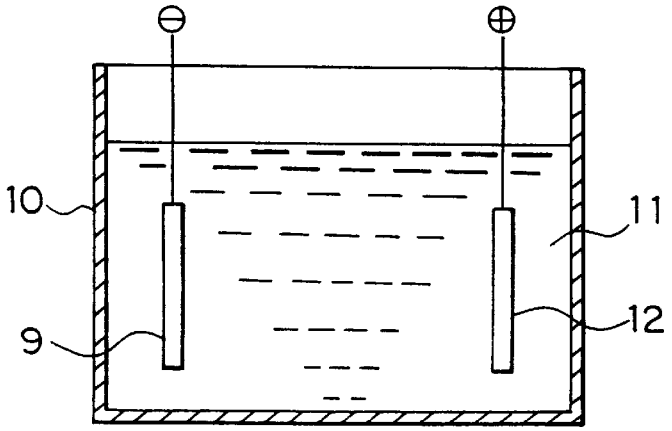
FIG. 7 is an illustrative cross-sectional view showing an equipment for electro-deposition coating according to one embodiment of the present invention.

A core for motor having the configuration as the multipolar radial thin plate 3 shown in FIG. 1 and wherein multipolar radial thin plates 5, having burr 5*a* are laminated as shown in FIG. 3. Grease is removed by electrolytic removal of grease, alkaline removal of grease, or other method. As shown in FIG. 7, core 9 is put in a electro-deposition coating fluid 11 contained in a electro-deposition vessel 10, the core 9 is suspended by a grounded wire as, for example, negative pole. On the other hand, the electro-deposition vessel itself may be a metal tank to serve as positive pole; however, a separately prepared stainless plate 12, serving as positive pole, is contained into the electro-deposition vessel 10 prepared separately in opposition to the core 9 (serving as negative pole).

Then, using a liquid cationic electro-deposition coating-material (anionic electro-deposition coat if negative and positive poles are set inversely), the electric power is applied between both poles, so that the electro-deposition coat particles are attracted to the core 9 by electric effect and cling to the surface thereof to coat on all the surface thereof with this coat film. Thereafter, this coat film is baked to obtain a primer coat film.

Next, powder coatings are applied to this primer coat film.

Figure 5:
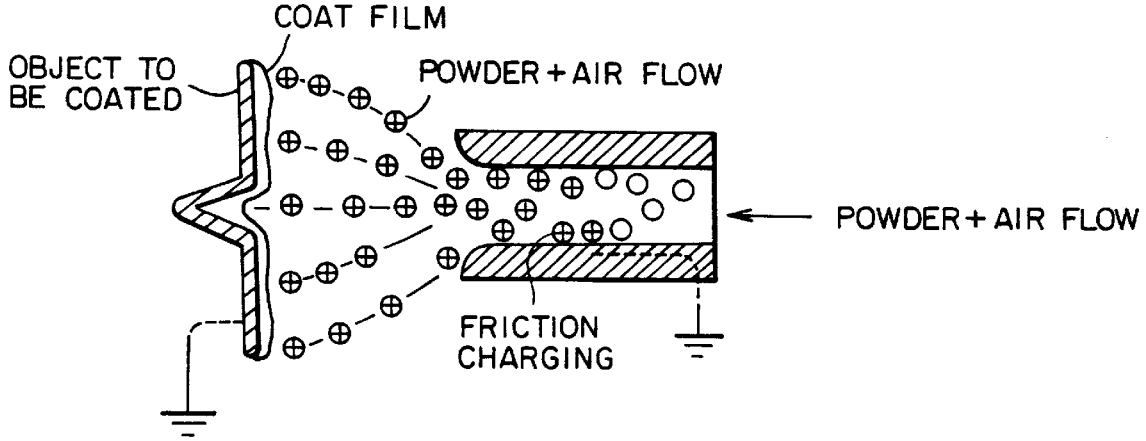
FIG. 5 is a figure showing the principle of a coating by a friction charging type electrostatic powder coating gun.
Figure 6:
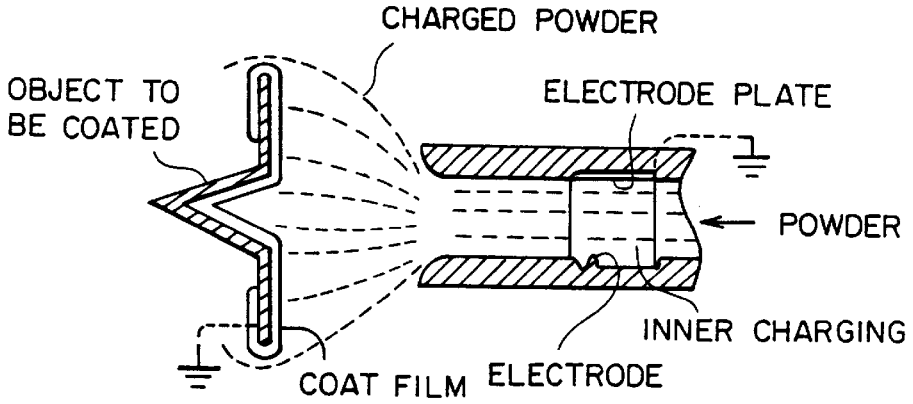
FIG. 6 is a figure showing the principle of a coating by a inner charging type electrostatic powder coating gun.
Figure 8:
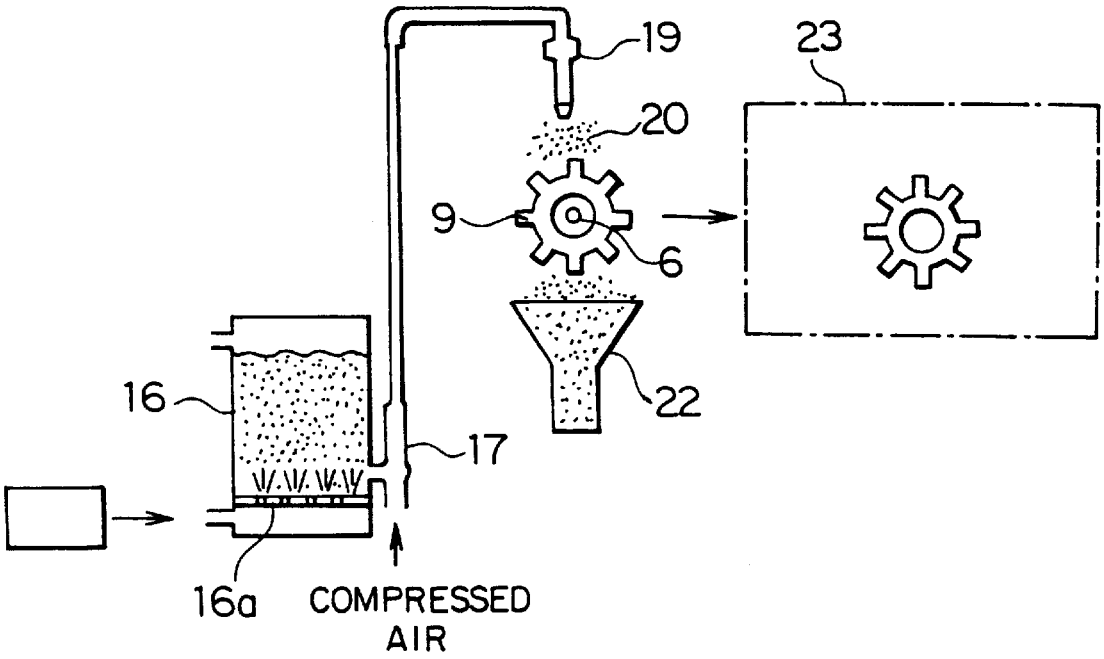
FIG. 8 is an illustrative view showing a process for powder coating according to one embodiment of the present invention.

As shown in FIG. 8, air is blown into a fluidization vessel 16 to fluidize powder coat on a porous plate 16*a*, the fluidized powder is sucked into a injector 17 and the charged powder coat particles 20 are sprayed from a friction charging type electrostatic powder gun 19 by compressed air. At this time, as shown in FIG. 5, the powder coatings delivered by the friction charging type electrostatic powder gun 19 are rubbed with the inner wall of the gun, so powder particles are charged and sprayed. Here, it is preferable to select powder coatings having an average particle diameter within the range of 4 $\mu$m to 40 $\mu$m.

Figure 4:
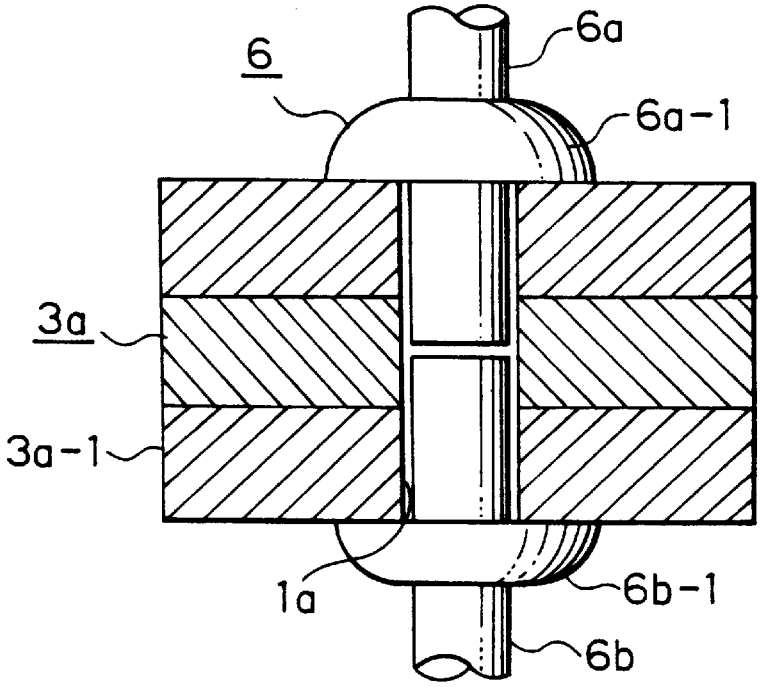
FIG. 4 is a cross-sectional view corresponding to the section B—B of FIG. 1 showing the state where the core of the laminated body of multipolar radial thin plate of FIG. 1 when the powder coat coating is performed.

The electro-deposited core 9, mentioned above, is supported by a jig 6 introduced in a central shaft hole, as shown in FIG. 4, and charged particles are sprayed by the friction charging type electrostatic powder gun 19 toward the center of the core, supported by its jig 6, so as to blow into the shaft hole are clung by electrostatic attraction. As opposed to the method for coating by electric field such as corona discharge electrostatic coating method, the slot peripheral wall is also well coated because the Faraday cage is not caused.

Thus, the core periphery is coated, but the powder coat which does not adhere to the object is sucked by a vacuum dust-catcher 22 disposed under the line, collected by a cyclone (not shown) and recycled.

The powder coated core 9 is heated and baked by a heater 23 disposed in front of the line.

The thickness of a coat film is adjusted mainly by means of selection of the particle diameter of the powder coats and charge value (gauge value), spray air pressure (Kg/cm2), atomization air pressure (Kg/cm2), and coat supply (g/min) of powder coatings of the friction charging type electrostatic powder gun. The charge amount of powder coatings being different according to a type of the powder coatings. It is necessary to select a type appropriate for the friction charging type electrostatic gun.

Figure 9:
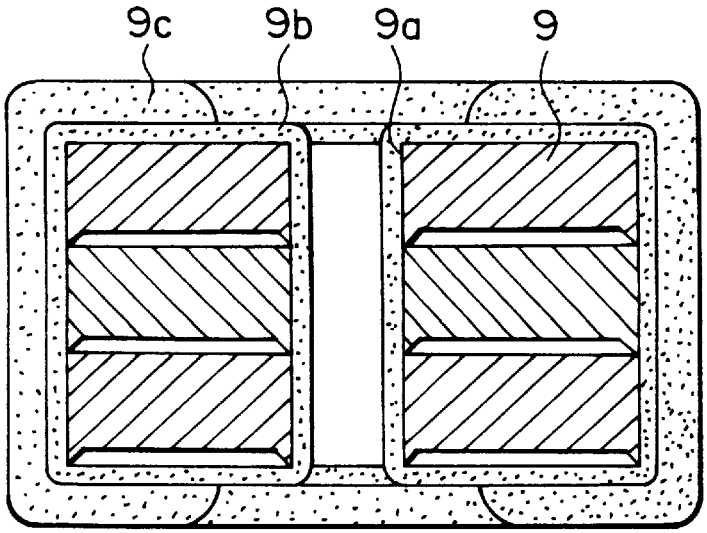
FIG. 9 is a cross-sectional view corresponding to the section B—B of FIG. 1 showing a portion of the coated body of the core corresponding to the laminated body of multipolar radial thin plate of FIG. 1 which can be obtained by the method of one embodiment of the present invention.

In this way, as shown in FIG. 9, an electro-deposited coat flm 9*b* is formed all over the surface of the core 9 including the core hole 9*a*, a coated body wherein a powder coat film 9*c* is formed except the portion covered by the jig 6 and not coated with powder coatings are obtained, and a winding is wound thereon to realize a winding coil for small-sized motor.

Figure 10:
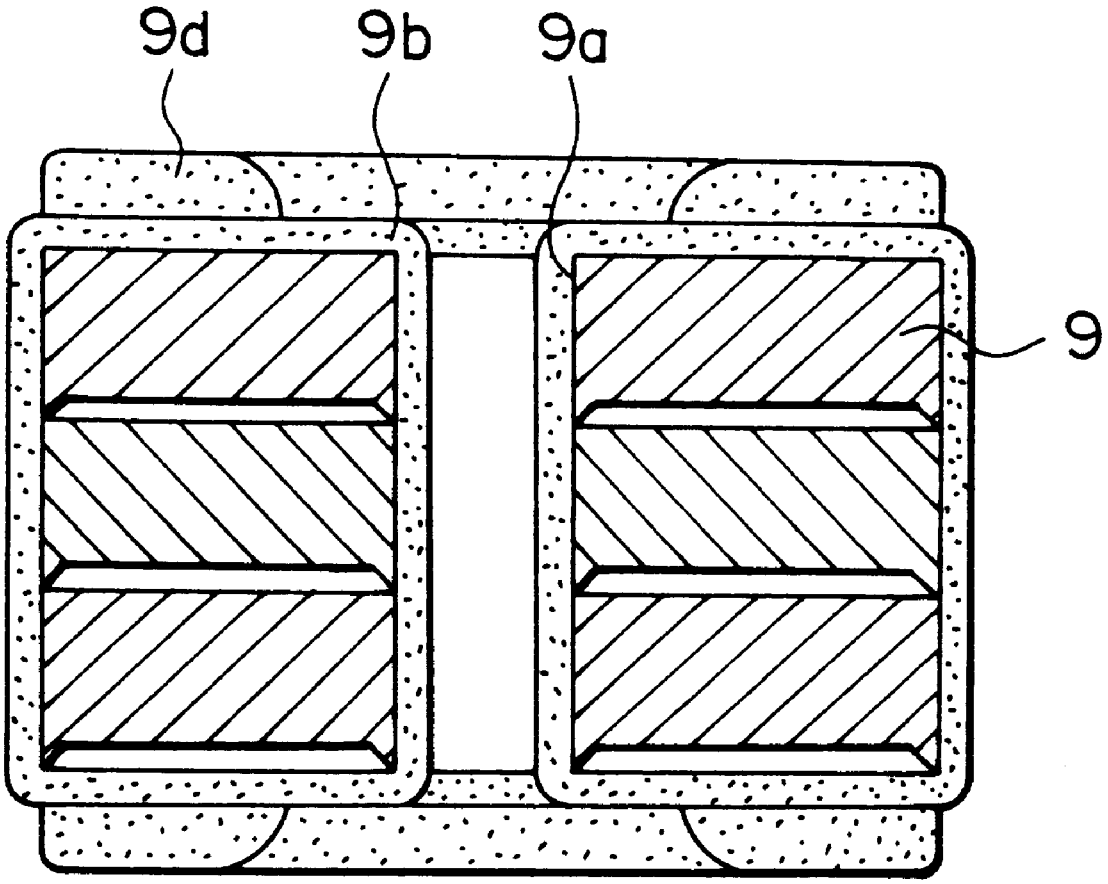
FIG. 10 is a cross-section corresponding to the section B—B of FIG. 1 showing a portion of the other coated body of the core corresponding to the laminated body of multipolar radial thin plate of FIG. 1 which can be obtained by the method of one embodiment of the present invention.

Here, as shown in FIG. 10, in place of disposing the powder coat film 9*c* in FIG. 9, powder coat film may not be disposed around the outer circumference side of the core 9 and powder coat film 9*d* may be disposed for the other portions in the same manner and, for this purpose, after the application of powder coatings. The powder coatings of the concerned portions is wiped off before baking.

Thus, when the coating is performed by the friction charging type electrostatic powder gun after the electro-deposition, the electro-deposition coat film is also formed in the shaft hole 9*a* of the core 9 and a jig may be introduced into the shaft hole and the powder coating can be performed by the former. So the shaft hole of the thus obtained coated body is prevented from rust occurring, and, at the same time, the other portions being coated with powder coat film. It can provide the function of insulation coating film. In this case, cavities of an object to be coated can be coated without causing the Faraday cage phenomenon, and, at the same time, the coat film thickness can be reduced by applying powder coatings of small average particle diameter.

In the foregoing, the coating method has been described in terms of a friction charging type electrostatic powder gun, but the coating by the inner charging type electrostatic powder gun can be performed by the same manner. Moreover, the corona charging type electrostatic powder coating method can also be used, and, in this case, as the electro-deposition film is formed on the portion that is not coated with powder coatings due to the Faraday cage phenomenon, such portion can be made to have the function of insulation coat film. Thus either of electrostatic powder coating methods may be used or obvious alternatives may be applied, some of which are described in the following examples.

The present invention will become more fully understood from the detailed description given hereinbelow and the accompanying drawings which are given by way of illustration only, and thus are not limitative of the present invention.

EXAMPLE 1

In the equipment of FIG. 7, the application of the liquid primer was performed. As electro-deposition coat 11, cation epoxy resin electro-deposition coat made by Uemura Kogyo Co., Ltd., commercial name New Paint ER (clearbase) is used. More particularly, in a beaker of 5 liters, 1 weight part of New Paint ER (clearbase) and 3 weight parts of deionized water are added and mixed sufficiently and core 9 is immersed.

When this electro-deposition liquid is poured into a electro-deposition vessel 10, the characteristics of the coatings in this electro-deposition vessel are 10% solid ingredient, acid ratio 0.7, pH 6.3, electric conductivity 1500 $\mu$S/cm, and temperature 28° C.

In this state, a voltage of 30 V is applied between the negative and positive poles for 3 minutes. By doing so, a coated body of the core 9 coated with electro-deposition coat all over the surface is obtained. In this case, a magnetic steel sheet is used for multipolar radial thin plate 5.

The core 9 of this coated body is taken out and washed out 3 times by a shower rinsing method with deionized water. It is set (left at the room temperature) in the room for 5 minutes to remove moisture, then, put in a hot air drying reactor to bake at 160° C. for 10 minutes and an electro-deposition coat film (electro-deposition coat film 9*b* of FIGS. 9 and 10) of 20 μm in average coat film thickness is formed on the core 9.

Next, in the equipment of FIG. 8, insulation powder coatings F-219MBC made by Somar Corp. is powder-coated by using a friction charging powder coating machine Tribomatic II made by Nordson Corp. The friction charging electrostatic powder gun 19 is heated at 200° C. for 10 minutes, for example, using a hot air oven as the heating means of the heater 23 and then left cooled down naturally. By doing so, an insulation powder coat film (powder coat film 9*c*, 9*d* of FIGS. 9 and 10) of 40 μm is formed, and, in total with the electro-deposition, an insulation coat film of 60 μm is formed.

Various tests mentioned below are performed on the thus obtained coat film and their results are shown in Table 1. Moreover, the core of the obtained coated body is wound regularly before performing various tests and the results thereof are shown in Table 2.

TABLE 1

| ITEM | ELECTRO-DEPOSITION | ELECTRO-DEPOSITION + POWDER COATINGS FILM |
|---|---|---|
| FILM THICKNESS(μm) | 20 | 60(20 + 40) |
| PENCIL HARDNESS | 2H | 3H |
| SOLVENT RESISTANCE | ACCEPTED | ACCEPTED |
| SALT WATER TEST | ACCEPTED | ACCEPTED |
| PEELING TEST | ACCEPTED | ACCEPTED |
| INSULATION RESISTANCE | | |
| DC 250 V, 20 MΩ | ACCEPTED | ACCEPTED |
| DC 500 V, 20 MΩ | REJECTED | ACCEPTED |
| BREAKDOWN VOLTAGE | AC 200 V REJECTED | AC 500 V ACCEPTED |

TABLE 2

| ITEM | ELECTRO-DEPOSITION FILM | ELECTRO-DEPOSITION + POWDER COATINGS FILM |
|---|---|---|
| DIELECTRIC STRENGTH | AVERAGE 0.61 kV | AVERAGE 1.3 kV |
| EDGE INSTRUCTION | PARTIAL NOTCH | NO NOTCH |
| DAMAGE OF ENAMEL WIRE | DAMAGED | NO DAMAGE |
| TENSION OF WINDING MACHINE | 100 TO 120 g | 130 TO 150 g |

The test method is as follows:

(1) Film thickness measurement

Measuring the film thickness of core flat sections with a electromagnetic film thickness meter (Elcometer) at 10 points (10 cores) to determine their average value.

(2) Pencil hardness test

Based on JIS K5400, the maximum hardness with which the coat film is not damaged by a Mitsubishi pencil "Uni" is defined as pencil hardness.

(3) Solvent resistance

A pad of gauze impregnated with methyl ethyl ketone is applied with pressure and withdrawn 25 times pressing; the coat film not solved by the gauze shall be accepted and the coat film solved and attached to the gauze rejected.

(4) Peeling-test

The coat film is cross cut by a knife in checkers and an adhesive tape (Cellotape) is attached to the coat film and then peeled. The coat film shall be accepted if the coat film does not peel and rejected if it peels even a little bit.

(5) Salt water test

A test piece of the coated body is immersed for 24 hours in 20° C. aqueous solution of 3% sodium chloride; the coat film shall be rejected if rust is detected by a microscope.

(6) Insulation resistance

The coated core is wound, respective coil ends are soldered so that they conduct and (+) terminal of an insulation resistance gauge is connected. The coat film of the core is exfoliated to expose the base metal and the earth (−) terminal is connected to the base metal to determine the presence of the current 250 V-50 MΩ.

(7) Breakdown voltage (dielectric breakdown test)

A part of coat film of the coated core is exfoliated to expose the base metal to which the earth terminal of the breakdown voltage test apparatus PAD-513 made by Phase Co., Ltd., connects the high voltage output terminal and the coat film surface are brought into contact for 1 second and the voltage of the time when the upper limit current value 0.5 mA/AC is attained shall be taken as the value of breakdown voltage.

(8) Dielectric strength

The high voltage output terminal of the destruction voltage test apparatus PAD-513 made by Phase Co., Ltd. and a winding coil are connected, then the earth terminal and the core are connected. The voltage of the time when the upper limit current value 0.5 mA/AC is attained shall be taken as the value of dielectric strength. One point respectively for 10 winding coils, in total 10 points are measured, their average value shall be taken as the value of dielectric strength and their standard deviation is determined.

(9) Edge intrusion

Figure 2:
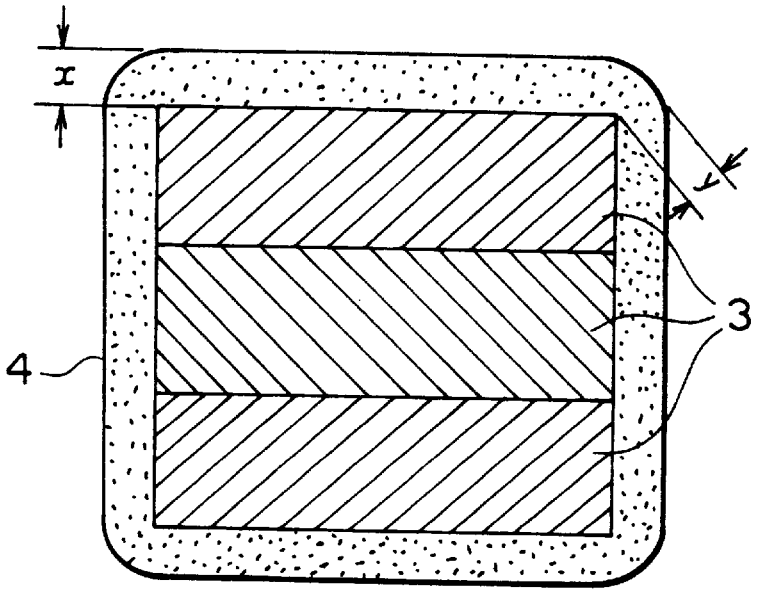
FIG. 2 is a cross-sectional view corresponding to the section A—A of FIG. 1 wherein an insulation coat film is formed on a laminated body of said multipolar radial thin plate.

The finished core whose winding is completely wound is embedded into epoxy resin and ground by a grinder to obtain the section shown in FIG. 2. Both the coatings of the corners and the burrs were observed under a microscope for coat film damage.

(10) Damage of copper wire

The insulation coat film of the copper winding (on the same section as the case of the (9) mentioned above) was observed for damage with a metal microscope.

(11) Winding machine tension

The tension value necessary for keeping the winding at a given state by applying a load to the enamel wire when the wire is wound around the coated core.

The results mentioned above shows that the coat film deposited only by the electro-deposition of primer is thin and the electro-deposition film is destroyed particularly at the edge portions by the winding tension of wire to reject the electric insulation. However, by performing powder coating, the destruction of the insulation coat film at the edge portions by the wire intrusion is reduced and there is no exposure of the base metal face, resulting in the acquisition of a good insulation. On the other hand, the total thickness of electro-deposition film and powder coat film attains 60um allowing to obtain a much thinner film in comparison to the electrostatic fluid immersion method. Moreover, from the results of the brine resistance test, it is understood that as an electro-deposition film is formed on the portions which are subsequently covered by a jig or on the portions of the outer circumference surface of the core shaft section where powder coat coating is not performed, the rust can be prevented from occurring and it is anticorrosive. Moreover, when the elecro-deposition coat film was not formed, rust appeared.

The present invention provides a method for manufacturing a coated body of a metal member for electronic components allowing to form a coat film of the thickness that would not be destroyed even in a metal member for electronic components having burrs and also to form a coat film on the portions, later to be covered by a jig, and are unable to be coated with powder coatings when the jig is employed or on the portions where powder coating is not applied. Thus, by forming a primer coat film on the portions where the powder coat film is not formed and by preventing the appearance of rust. It can provide a small-sized motor the ability to maintain its performance for a long period of time and to improve the reliability of a small-sized motor used for the computer related electronic devices.

On the other hand, by applying powder coatings by the friction charging type electrostatic powder coating method or the inner charging type electrostatic powder coating method, a thin film coat can be formed on a small electric member having cavities, for example, core of small-sized motor, and formed, without deteriorating the other characteristics as an insulating coat film.

Moreover, the coat film can be made thinner without damaging the edge cover rate to provide, for instance, a small-sized motor permitting to obtain a high torque performance. Furthermore, in a small-sized motor having a small capacity, its core winding can be shortened, and its size can be minimized. In addition, its electric resistance can be reduced, so the heat generation during its operation can be limited, and a component having an excellent insulation coat film for the core of motors which are being further minimized c an be provided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Notification of symbols

9 core as negative pole

9*b* electro-deposition film

9*c* powder coat film

11 liquid coating of electro-deposition

12 stainless plate as negative pole

19 friction charging type electro-static powder gun

20 powder coatings particle

What is claimed is:

1. A method of forming insulating coatings on a concave metal member to be used for a precision electronic device useful in electrical communications, for a computer or for a peripheral device of said computer, said method comprising the steps of:

applying a liquid coating material to said concave metal member thereby forming a primer insulating coating on said concave metal member; and applying an insulating powder coating material to the primer coated metal member by means of powder coating with a friction charging electrostatic powder gun or an inner charging electrostatic powder gun thereby forming an insulating powder coat film having a thickness of 10 to 100 $\mu$m on the primer coated metal member.

2. The method according to claim 1, wherein said step of forming a primer insulating coating is performed by means of electro-deposition.

3. The method according to claim 1 or 2, wherein said concave metal member is a core for an electric motor.

4. The method according to claim 1 or 2, wherein said concave metal member is a core for a transformer.

5. A method of forming insulating coatings films on a concave metal member to be used for a precision electronic device useful in electrical communications, for a computer or for a peripheral device of said computer, said method comprising the steps of:

applying a liquid coating material to said concave metal member thereby forming a primer insulating coating on said concave metal member;

affixing the primer coated metal member to a jig; and applying an insulating powder coating material to the primer coated metal member by means of powder coating with a friction charging electrostatic powder gun or an inner charging electrostatic powder gun thereby forming an insulating powder coat film having a thickness of 10 to 100 $\mu$m on the primer coated metal member.

6. The method according to claim 5, wherein said step of forming a primer insulating coating is performed by means of electro-deposition.

7. The method according to claim 6, wherein said concave metal member is a core for an electric motor.

* * * * *